US011643803B2

(12) United States Patent
Nyce

(10) Patent No.: US 11,643,803 B2
(45) Date of Patent: May 9, 2023

(54) COMPOSITE CONSTRUCTION FOR SECURE COMPARTMENTALIZED ENCLOSURE

(71) Applicant: Randall Engineered Wall Systems, Inc., Apopka, FL (US)

(72) Inventor: Daniel Nyce, Winter Garden, FL (US)

(73) Assignee: Randall Engineered Wall Systems, Inc., Apopka, FL (US)

( * ) Notice: Subject to any disclaimer, the term of this patent is extended or adjusted under 35 U.S.C. 154(b) by 0 days.

(21) Appl. No.: 17/327,008

(22) Filed: May 21, 2021

(65) Prior Publication Data

US 2021/0363746 A1 Nov. 25, 2021

Related U.S. Application Data

(60) Provisional application No. 63/028,152, filed on May 21, 2020.

(51) Int. Cl.

| | |
|---|---|
| ***E04B 1/04*** | (2006.01) |
| ***E04H 3/08*** | (2006.01) |
| ***E04B 1/343*** | (2006.01) |
| ***E04C 2/04*** | (2006.01) |
| ***E04B 2/56*** | (2006.01) |

(52) U.S. Cl.

CPC ..... *E04B 1/043* (2013.01); *E04B 1/34384* (2013.01); *E04B 2/56* (2013.01); *E04C 2/044* (2013.01); *E04H 3/08* (2013.01); *E04B 2103/02* (2013.01)

(58) Field of Classification Search

CPC .. E04B 1/043; E04B 1/34384; E04B 2103/02; E04B 2/56

USPC ..... 52/106

See application file for complete search history.

(56) References Cited

U.S. PATENT DOCUMENTS

| | | | | |
|---|---|---|---|---|
| 2,054,665 A * | 9/1936 | Tracy | E04H 3/08 | 52/106 |
| 3,566,560 A * | 3/1971 | Wakefield et al. | E04B 1/043 | 52/432 |
| 3,722,152 A * | 3/1973 | Schlatter | E04H 3/08 | 52/106 |
| 3,729,875 A * | 5/1973 | Felson | E04B 1/3412 | 52/79.14 |
| 3,760,540 A * | 9/1973 | Latoria | E04C 2/384 | 52/125.5 |

(Continued)

FOREIGN PATENT DOCUMENTS

| | | | | |
|---|---|---|---|---|
| GB | 2488582 A * | 9/2012 | ..... | E04B 1/34823 |

*Primary Examiner* — Brian D Mattei
*Assistant Examiner* — Joseph J. Sadlon
(74) *Attorney, Agent, or Firm* — GrayRobinson, P.A.; Michael J. Colitz, III

(57) ABSTRACT

Disclosed are various secure enclosures and associated composite construction methods. The described enclosures preferably utilize one or more prefabricated concrete walls that are mated to one or more metal panels. The panels include hollow ends that are secured to anchors formed within the prefabricated walls. This connection joins the concrete wall and the metal panel in a secure and tamper proof manner. The disclosed methods allow enclosures to be quickly constructed and easily configured depending upon the particular needs of the facility. The enclosures are cost effective, scalable, and easy to assemble.

12 Claims, 8 Drawing Sheets

(56) References Cited

U.S. PATENT DOCUMENTS 3,782,061 A * 1/1974 Minutoli ..... E04B 1/06 52/298
3,837,128 A * 9/1974 O'Brien ..... E04B 2/82 52/282.2
3,991,528 A * 11/1976 Dillon ..... B66B 11/0005 52/79.14
4,551,961 A * 11/1985 Kiselewski ..... E04B 1/161 264/273
4,854,094 A * 8/1989 Clark ..... E04B 1/3483 52/234
4,987,719 A * 1/1991 Goodson, Jr. ..... E04B 1/24 52/378
5,012,621 A * 5/1991 Power ..... E04B 1/34869 52/745.03
5,178,581 A * 1/1993 Del Monte ..... F24F 7/08 454/239
5,400,553 A * 3/1995 Brennan ..... E04H 3/08 52/270
6,463,702 B1 * 10/2002 Weaver ..... E04B 1/04 52/250
6,494,004 B1 * 12/2002 Zimmerman ..... B28B 19/003 249/35
6,604,328 B1 * 8/2003 Paddock ..... E04H 1/1205 52/270
7,178,297 B2 2/2007 Seavy
7,318,300 B1 * 1/2008 Seavy ..... E04H 3/08 52/106
8,375,677 B1 * 2/2013 Weiler ..... E04G 15/061 52/745.1
8,381,454 B1 * 2/2013 Robinson ..... E04H 3/10 52/63
8,833,002 B2 * 9/2014 Lack, Jr. ..... E04B 1/38 52/106
10,738,437 B1 * 8/2020 Allen ..... E02D 29/0275
2005/0188624 A1 * 9/2005 Aaronson ..... E04B 1/34823 52/79.11
2019/0010692 A1 * 1/2019 Segall ..... E04H 1/005
2019/0032325 A1 * 1/2019 Seavy ..... E04B 2/74
2021/0363753 A1 * 11/2021 Valente ..... B32B 7/05

* cited by examiner

COMPOSITE CONSTRUCTION FOR SECURE COMPARTMENTALIZED ENCLOSURE

CROSS REFERENCE TO RELATED APPLICATIONS

This application claims priority to Provisional Patent Application Ser. No. 63/028,152, filed on May 21, 2020, entitled "Composite Construction for Secure Compartmentalized Enclosure," the contents of which is fully incorporated herein for all purposes.

TECHNICAL FIELD

This disclosure relates to an enclosure formed from a composite construction. More particularly, the present disclosure relates to a secure enclosure of the type used for jails, prisons, or containment cells and that is formed from composite construction techniques.

BACKGROUND OF THE INVENTION

Over the last several decades, the rate of incarceration in the United States has sharply increased. With this increase comes an increasing demand for prisons, jails, and similar containment facilities. Federal, state and local government agencies, as well as private entities, are faced with the task of building these secure facilities. In each case, building these secure facilities involves many often competing demands. One the one hand, the facilities must house inmates in a manner that prevents escape and that allows inmates to be compartmentalized within certain defined locations within the facility. On the other hand, these facilities must be scalable and capable of inexpensive and quick construction.

The background art contains several examples of construction techniques for secure facilities. U.S. Pat. No. 7,178,297 to Seavy discloses various steel structures made from interlocking steel modules. The wall modules are formed from plate steel and are assembled together using C-channel connectors. The interlocking tongue and grove construction allows for quick and cost-effective construction. Similarly, U.S. Pat. No. 8,833,002 to Lack, Jr. discloses a design and method for constructing and installing a cell front panel. The design allows for the construction and installation of cell fronts to occur at any time during the construction of the facility using only small hand tools and non-specialized workers.

Although the background art discloses various secure construction methods, all of the background art suffers from one or more drawbacks. For example, the background art fails to fully employ composite construction methods, and therefore, fails to allow facilities to be secure, quickly assembled, and cost effective. The secure compartmentalized enclosure of the present disclosure is designed to fulfill these and other shortcomings present within the art.

SUMMARY OF THE INVENTION

This disclosure relates to a secure enclosure that employs a composite construction.

The disclosed enclosure has several important advantages. For example, the enclosure can have some components manufactured from pre-fabricated concrete and other components manufactured from metal.

The present enclosure also benefits from interconnecting the concrete components and the metal components in a secure and tamper proof manner.

A further advantage is attained by allowing a metal divider or wall to be quickly and easily fitted into a pre-fabricated concrete structure, thereby greatly reducing manufacturing times and costs.

Yet another advantage is realized by allowing a metal divider to be secured to a pre-fabricated concrete structure via a secure and tamper proof connection.

Still yet another benefit is achieved by allowing a metal divider to be placed within an outer concrete shell, whereby the size and configuration of individual cells can be adjusted and modified during the manufacturing process.

Another benefit is realized by securing the metal divider in a fully encapsulated manner such that the edges of the divider are inaccessible.

The enclosure disclosed herein benefits from being quickly erected, cost effective, scalable, and secure.

It is another advantage to reduce manufacturing costs by reducing the need for specialized tooling.

Various embodiments of the invention may have none, some, or all of these advantages. Other technical advantages of the present invention will be readily apparent to one skilled in the art.

BRIEF DESCRIPTION OF THE DRAWINGS

For a more complete understanding of the present disclosure and its advantages, reference is now made to the following descriptions, taken in conjunction with the accompanying drawings, in which.

Similar reference numerals refer to similar parts throughout the several views of the drawings.

| Parts List |
|---|
| 18 Secure Facility |
| 20 Concrete Structure |
| 21 Open Bottom of Structure |
| 22 Concrete Walls |
| 22a Far Wall/22b Near Wall |
| 24 Door and Door Frame |
| 26 Window Frames |
| 28 Toilet/Sink Unit |
| 32 Desk |

-continued

| Parts List |
|---|
| 34 Bed |
| 36 Metal Panel |
| 38 Main Divider |
| 40 Individual Cell |
| 42 Chase (Two Legs) |
| 44 Hollow Opening Main Divider |
| 46 Hollow Opening in Chase |
| 48 Sub-Compartment between Legs |
| 50 Recess in Concrete Wall |
| 52 Recessed Concrete Anchor (Far Wall) |
| 53 Bolt for Concrete Anchor 52 |
| 54 Metal Channel for Main Divider |
| 55 Lower Edge of Metal Channel |
| 56 Recessed Concrete Anchor(Near Wall) |
| 57 Bolt for Concrete Anchor 56 |
| 58 Angle Iron for Leg |
| 59 Lower Edge of Leg |
| 60 Recess in Concrete Ceiling |
| 62 Recessed Concrete Anchor (Ceiling) |
| 63 Bolt for Concrete Anchor 62 |
| 64 Ceiling |
| 66 Ceiling Channel |
| 67 Lower Edge of Ceiling Channel |

DETAILED DESCRIPTION OF THE DRAWINGS

The present invention relates to secure enclosures and to composite construction methods for assembling such enclosures. The described enclosures preferably utilize a prefabricated concrete structure that is mated to one or more metal panels. The metal panels include hollow ends that are connected to anchors formed within the walls of the prefabricated concrete structure. A further connection can be made between an upper edge of the metal panel and the ceiling. These connections join the metal panel to the concrete structure in a secure and tamper proof manner. The disclosed methods allow enclosures to be quickly constructed and easily configured to meet the needs of the particular facility. The enclosures are cost effective, scalable, and easy to assemble. The various details of the present disclosure, and a manner in which they interrelate, are described in greater detail hereinafter.

Figure 1A:
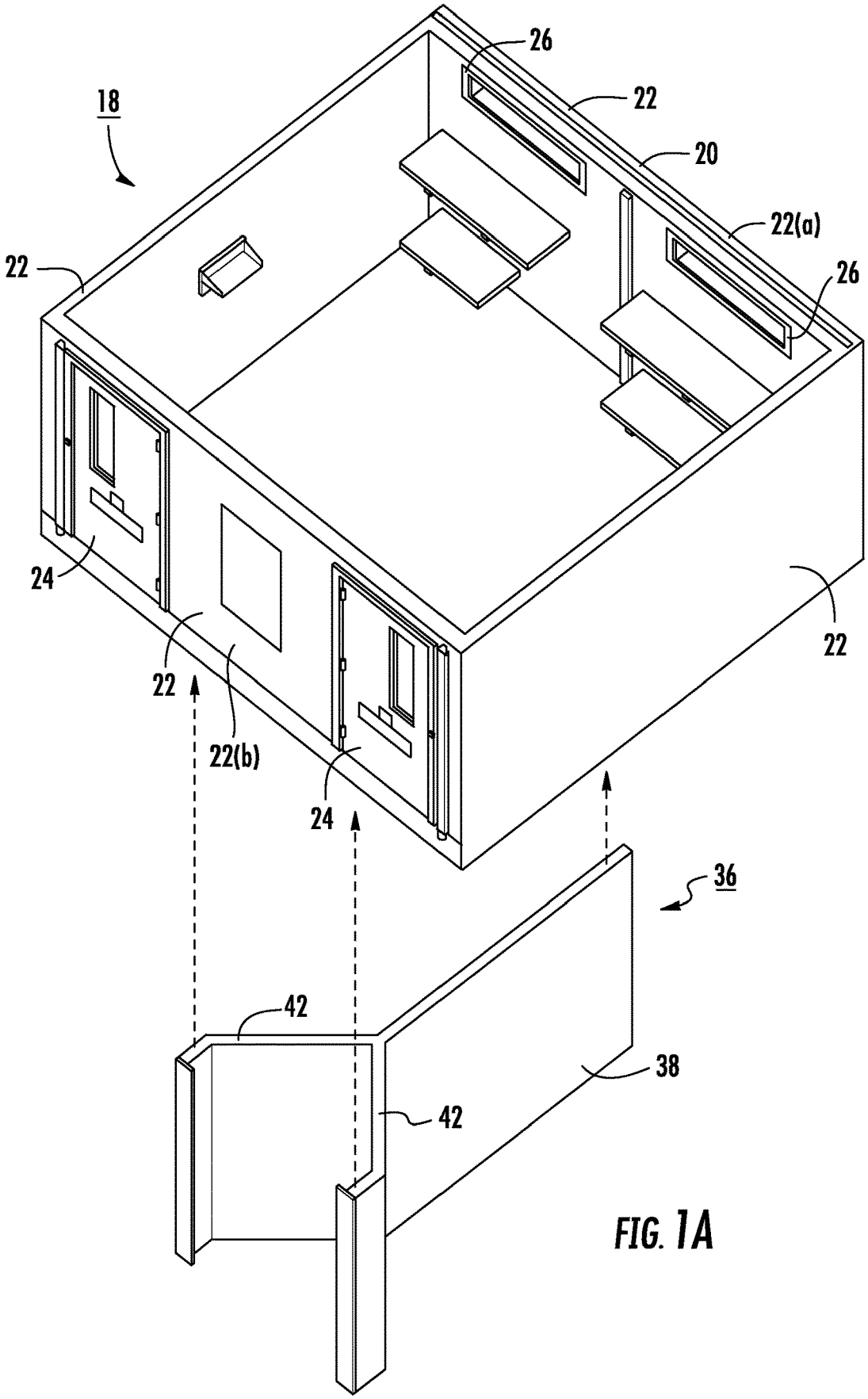
FIG. 1A is perspective view of a metal partition being fitted into a pre-fabricated concrete structure.
Figure 1B:
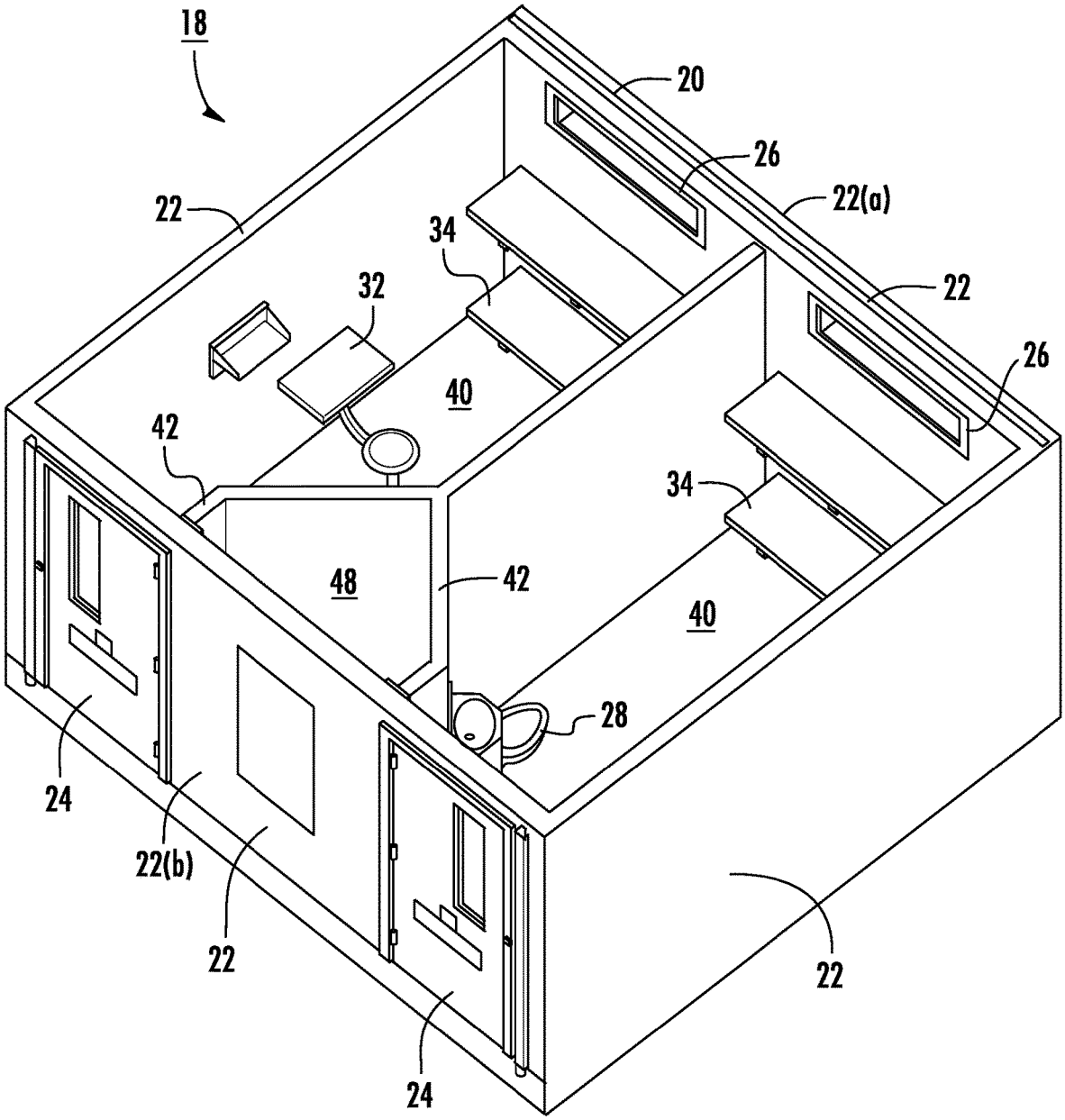
FIG. 1B is a perspective view of the metal partition fitted into the pre-fabricated concrete structure.
Figure 5:
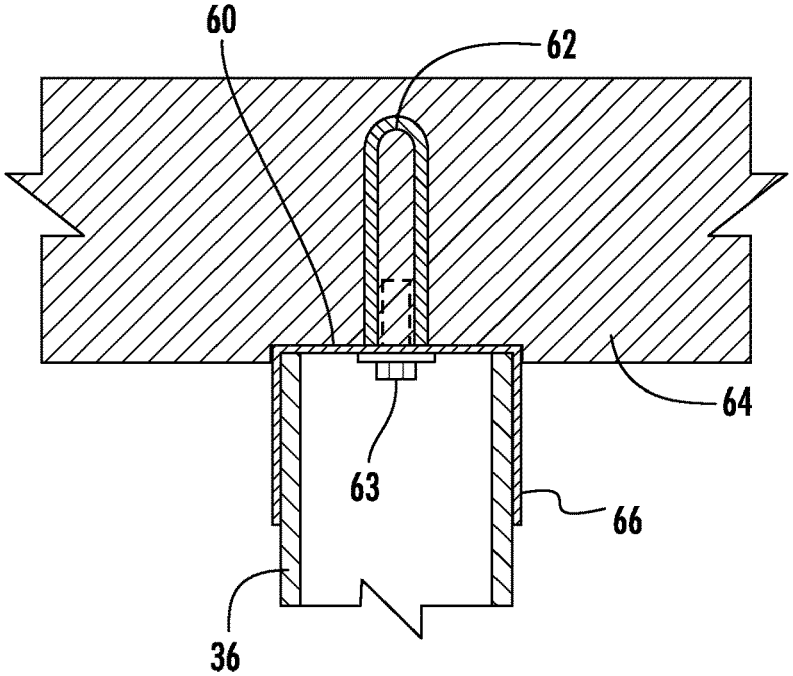
FIG. 5 is a detailed view of the upper edge of the metal partition fitting into a ceiling mounted C-shaped channel.

With reference to FIG. 1, the primary component of the facility 18 is a pre-fabricated concrete structure 20. As used herein, "pre-fabricated" means that one or more elements of the concrete structure 20 are constructed at a plant that may be remote from the location at which the ultimate facility 18 is being erected. In the depicted embodiment, the prefabricated concrete structure 20 includes four concrete walls 22 (FIG. 1A) and a ceiling 64 (note FIG. 5) that are erected in a rectangular configuration using any of a variety of known concrete construction techniques. Structure 20 includes an opened bottom 21. Although four walls are depicted, structure 20 can be formed from fewer than four walls may not include a ceiling and can generally be formed into any of a wide variety of shapes and sizes depending upon the needs of the facility being built.

Structure 20 is preferably formed without a floor to enable panel 36 to slid into structure 20 as depicted. The bottom of structure 20 can be anchored to a slab-on-grade foundation. In multistory structures (FIG. 1C and FIG. 5), the ceiling 64 of the lower structure 20 forms the floor of the upper structure 20. As is known in the art, the precast structure 20 may be made utilizing rebar or rebar cages that are initially held within a concrete form. In this regard, the walls and ceiling can be monolithically cast using known techniques. The concrete may be pre or post tensioned. The pre-fabricated concrete structure 20 may have one or more door frames and doors 24 to provide access to the interior of the structure 20. In the event structure 20 is intended for use as a prison or jail cell, fixtures can be provided within the walls for affixing toilet/sink combinations 28, desks 32, or beds 34.

The depicted precast concrete structure 20 is divided into two individual cells 40 by way of a centrally located metal panel 36. In the preferred embodiment, this metal panel 36 bisects the concrete enclosure 20 to create two equally sized cells 40. However, panel 36 can be configured and secured to create individual cells 40 of varying shapes and sizes. The use of multiple, smaller panels 36 is also within the scope of the present disclosure. Metal panel 36 can be fitted into the concrete structure 20 by sliding the panel 36 upwardly from the bottom of structure 20 as noted by the dotted arrows in FIG. 1A. Panel 36 is preferably secured in this fashion after the concrete structure 20 is formed. The manner in which panel 36 connects to structure 20 is described in greater detail hereinafter. Panel 36 and concrete structure 20 are preferably joined together at an offsite facility and thereafter delivered to a jobsite (i.e. the ultimate location of the secure facility 18) using a tractor trailer or similar conveyance. Alternatively, structure 20 and panel 36 can be joined together at the location of the facility 18. In a preferred but non-limiting example, panel 36 is formed from 12 Ga (0.093 inches or 2.3 mm) thick metal with a Zinc coating that is applied using a hot-dip process and that conforms to ASTM A 653/A 653M Commercial Steel (CS) coating designation A60 (Z180).

Figure 3A:
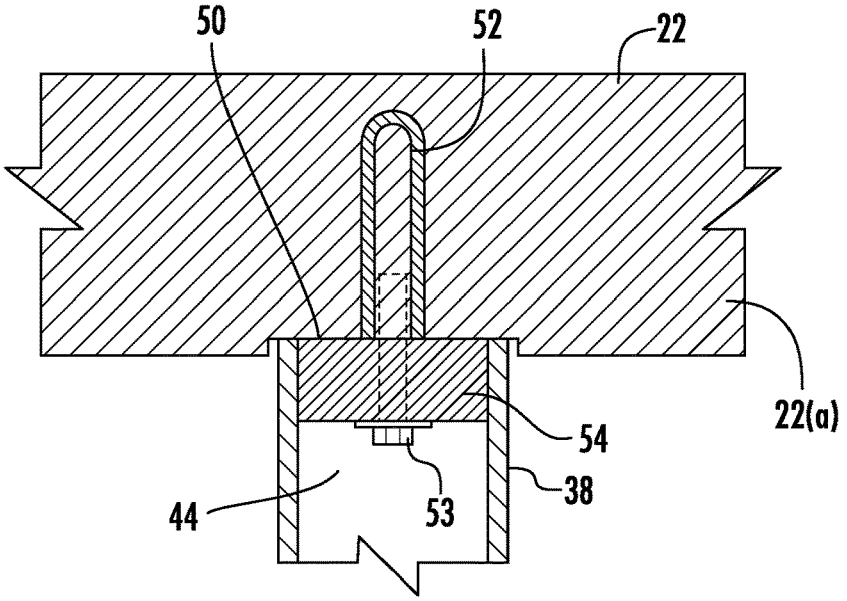
FIG. 3A is a detailed view taken from 3A of FIG. 2.
Figure 3B:
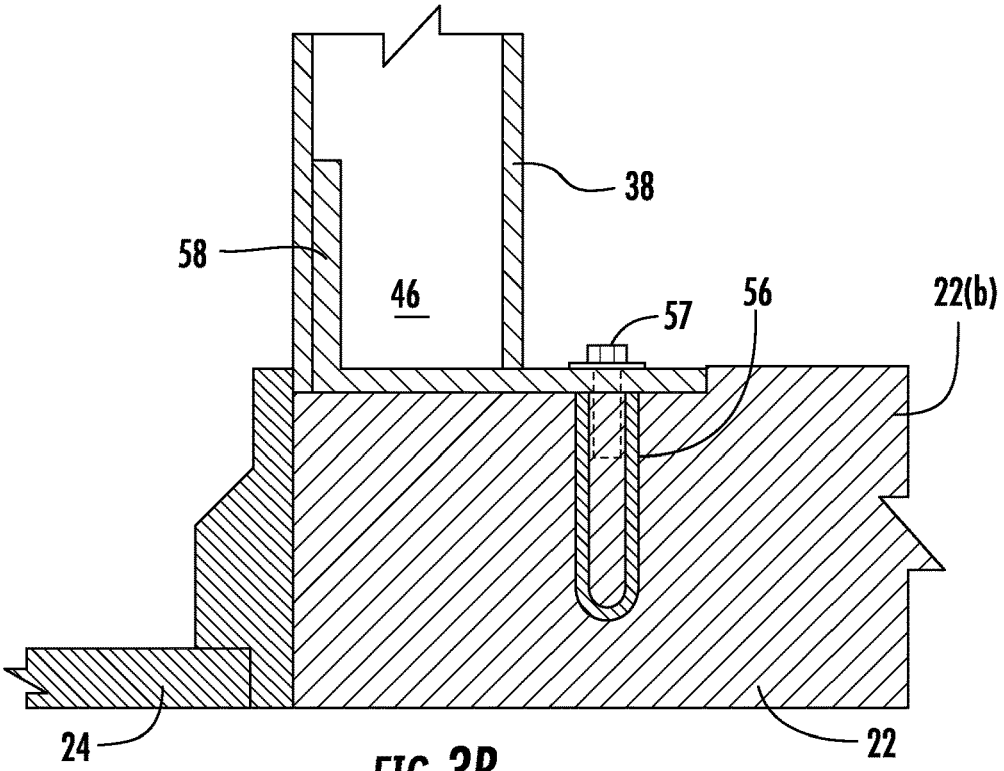
FIG. 3B is a detailed view taken from 3B of FIG. 2

The metal panel 36 in the embodiment of FIG. 1A includes both a main divider 38 and a chase 42 with two opposing legs. In a non-limiting example, main divider 38 is anchored to the far wall 22(*a*) of the enclosure 20 (the wall containing widow frames 26), and the two opposing legs 42 are anchored to the near wall 22(*b*) of the enclosure 20 (the wall housing the door frames 24). In the preferred embodiment metal panel 36 is hollow with both the far and near ends including hollow openings (44 and 46) (FIGS. 3A and 3B). The two legs 42 of the metal panel 36 create a triangular shaped sub-compartment 48 that is positioned between the two individuals cells 40. This triangular sub-compartment 48 may be used to house the plumbing and/or electrical conduits needed by the associated cells 40.

As noted in FIG. 3A, the far wall 22(*a*) of the concrete structure 20 includes a metal channel 54 that runs the entire height of far wall 22(*a*). Metal channel 54 is secured in place by a series of concrete U-shaped anchors 52 that are cast in place during the manufacture of structure 20. Each anchor 52 includes a threaded aperture into which a bolt 53 can be secured. Channel 54 includes corresponding apertures that receive bolts 53. In this manner, bolts 53 are used to secure channel 54 to the corresponding anchors 52 within far wall 22(*a*). Channel 54 includes a lower edge 55. The result is a metal channel 54 that is securely fastened within the far concrete wall 22(*a*) and that protrudes a distance from the surface of the wall. As noted in FIG. 3A, in the preferred embodiment, wall 22 includes a recess 50 for receiving channel 54. Recess 50 can be, for example, between ¼" to ½" deep. The hollow opening 44 of the main divider 38 is thereafter secured over top of this exposed channel 54. In order to prevent tampering with the connection, the edges of the main divider 38 are completely received within recess 50 the concrete wall 22. This results in the ends of divider 38 being recessed into wall 22 and inaccessible to the occupant of the cell. Spot welding may be used to weld main divider 38 to metal channel 54 and thereby increase the security of the connection.

Figure 4:
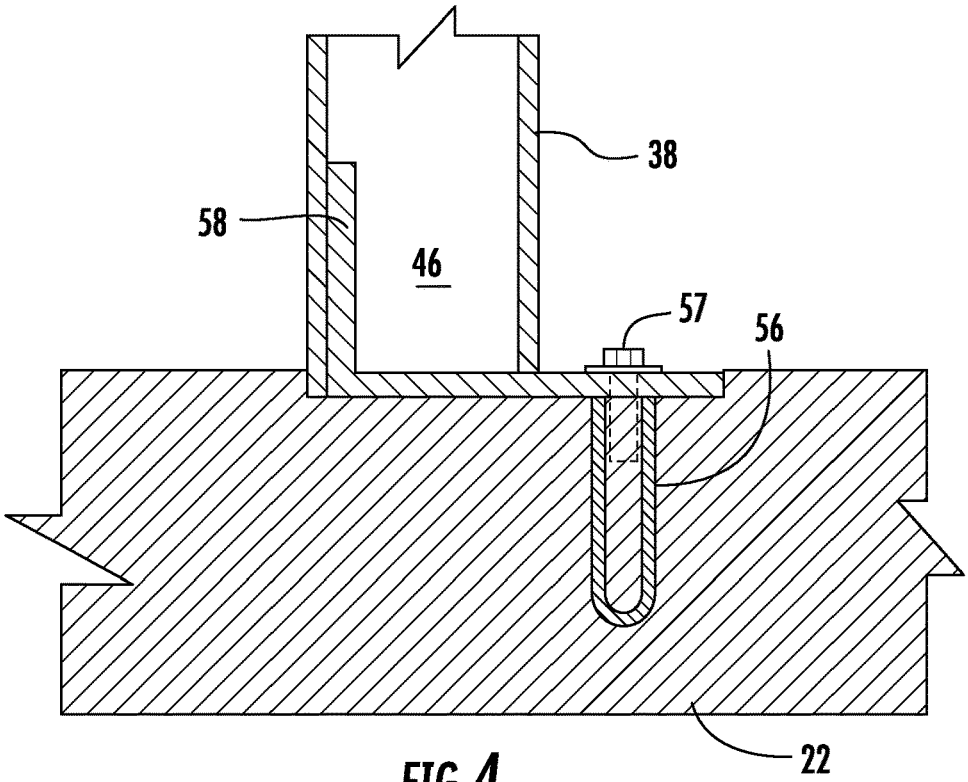
FIG. 4 is a detailed view of an alternative construction to that depicted in FIG. 3B.

As noted in FIG. 3B, each of the opposite legs 42 of panel 36 are secured in place by similar U-shaped anchors 56 and associated bolts 57. Again, these anchors 56 are cast into wall 22 as it is formed. Each of these anchors 56 secures an associated bolt 57. Bolts 57, in turn, are used to secure a length of an L-shaped angle iron 58. Angle iron 58 includes a lower edge 59. This is preferably one long length of angle iron 58 extending the length of the wall 22. Alternatively, a series of shorter, individual angle irons can be employed. In either event, the angle iron(s) 58 are secured in place adjacent to one of the door frames 24. The exposed leg of each angle iron 58 is then securely fastened within the hollow opening 46 of a corresponding leg 42. As noted in FIG. 3B, angle iron 58 is recessed into wall 22 and the end of each leg 42 is flush against angle iron 58 when installed. This prevents the edges of divider 36 from being exposed. Again, spot welding may be employed to permanently secure each leg 42 to one or more associated angle irons 58. FIG. 4 illustrates an angle iron 58 secured to wall 22 but at a location remote from a door and frame 24.

As a result of the channel 54 and angle iron 58, metal panel 36 is securely anchored between the near and far walls (22(*a*) and 22(*b*)) of concrete structure 20. Notably, divider 36 is secured and fully encapsulated in a way to prevent the ends of the divider 36 from being accessed or tampered with. In one embodiment, appropriate cut-outs may be provided at the top of panel 36 to permit it to be slide into place from the bottom of concrete structure 20 as noted in FIG. 1A.

Figure 1C:
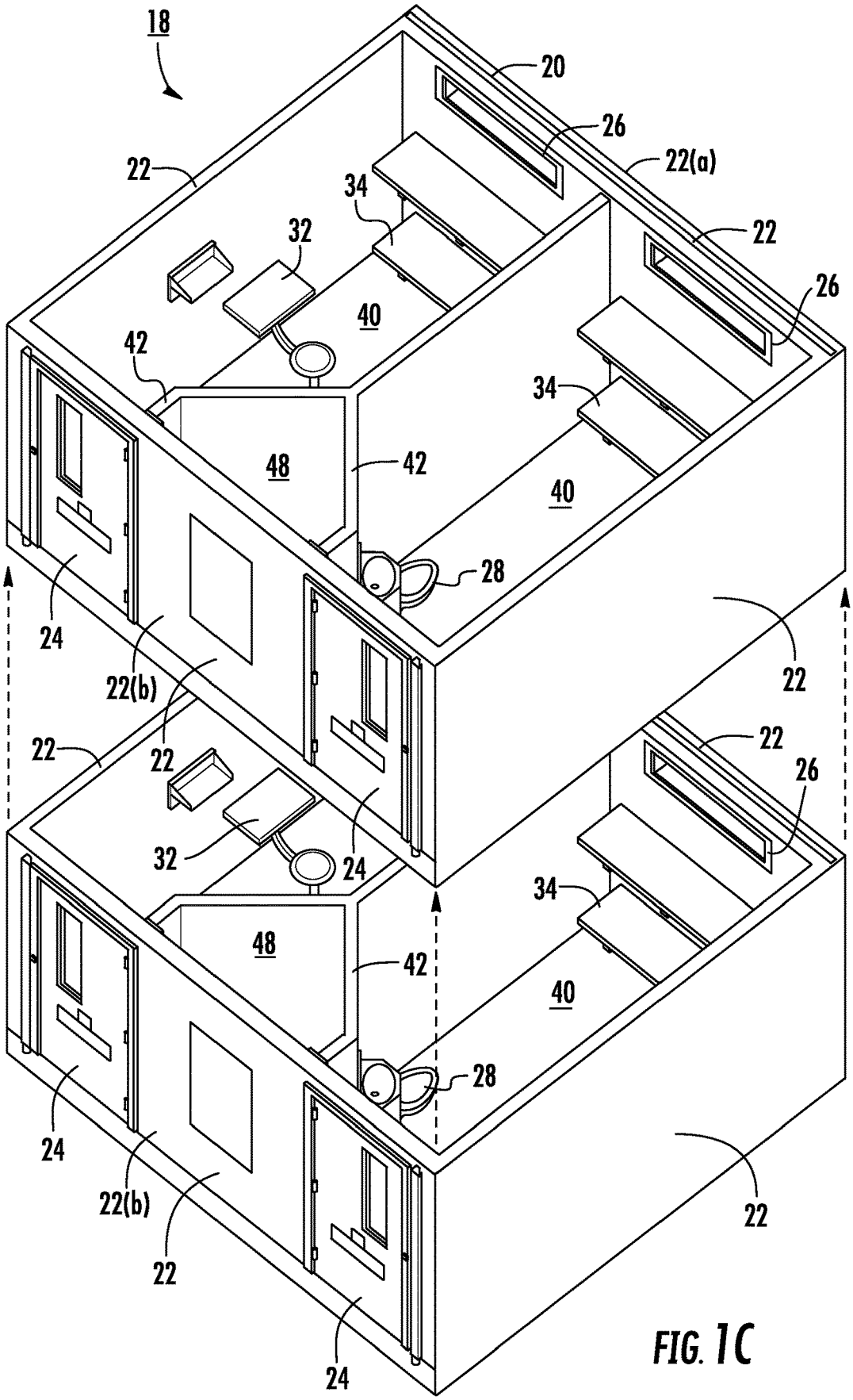
FIG. 1C is a perspective view of a multistory building constructed in accordance with the present disclosure.
Figure 2:
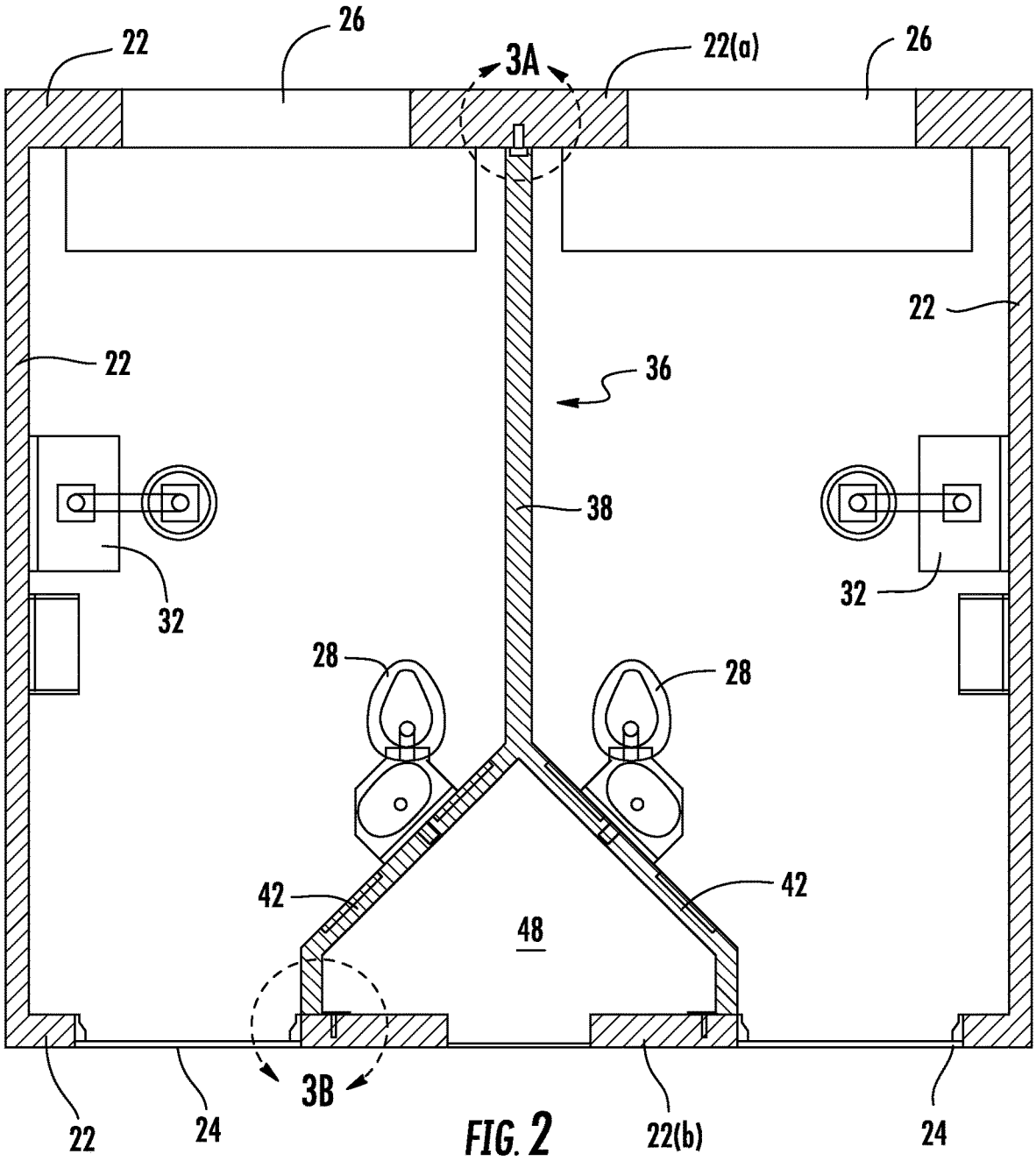
FIG. 2 is a sectional view of a building taken along line 2-2 of FIG. 1B and constructed in accordance with the present disclosure.

Panel 36 is further secured in place by attaching the upper edge of panel 36 to the ceiling 64 of concrete structure 20. To accomplish this, and as noted in FIG. 5, ceiling 64 of structure 20 includes additional U-shaped anchors 62 and associated bolts 63. As described above, anchors 62 are cast in place during the formation of structure 20. These anchors/bolts (62 and 63) are used to secure a U-shaped channel 66 that runs the length of the ceiling 64 and the length of structure 20. U-shaped channel 66 includes a lower edge 67. Into this channel, the upper extent of panel 36 is secured. Again, this can be accomplished by sliding divider 36 upwardly from the bottom of structure 20. Notably, the top extent of divider 36 is received within the U-shaped divider 66; this prevents the upper end of divider 36 from being exposed. Additionally, a recess 60 is preferably provided within ceiling 64 for receiving channel 66. Spot welding can be used as needed to provide a more secure connection. The depicted anchors/bolts can be used to secure the compartment to a foundation at the site of the facility. They may likewise provide a connection between adjacent floors of a multistory structure (FIG. 1C).

Figure 6:
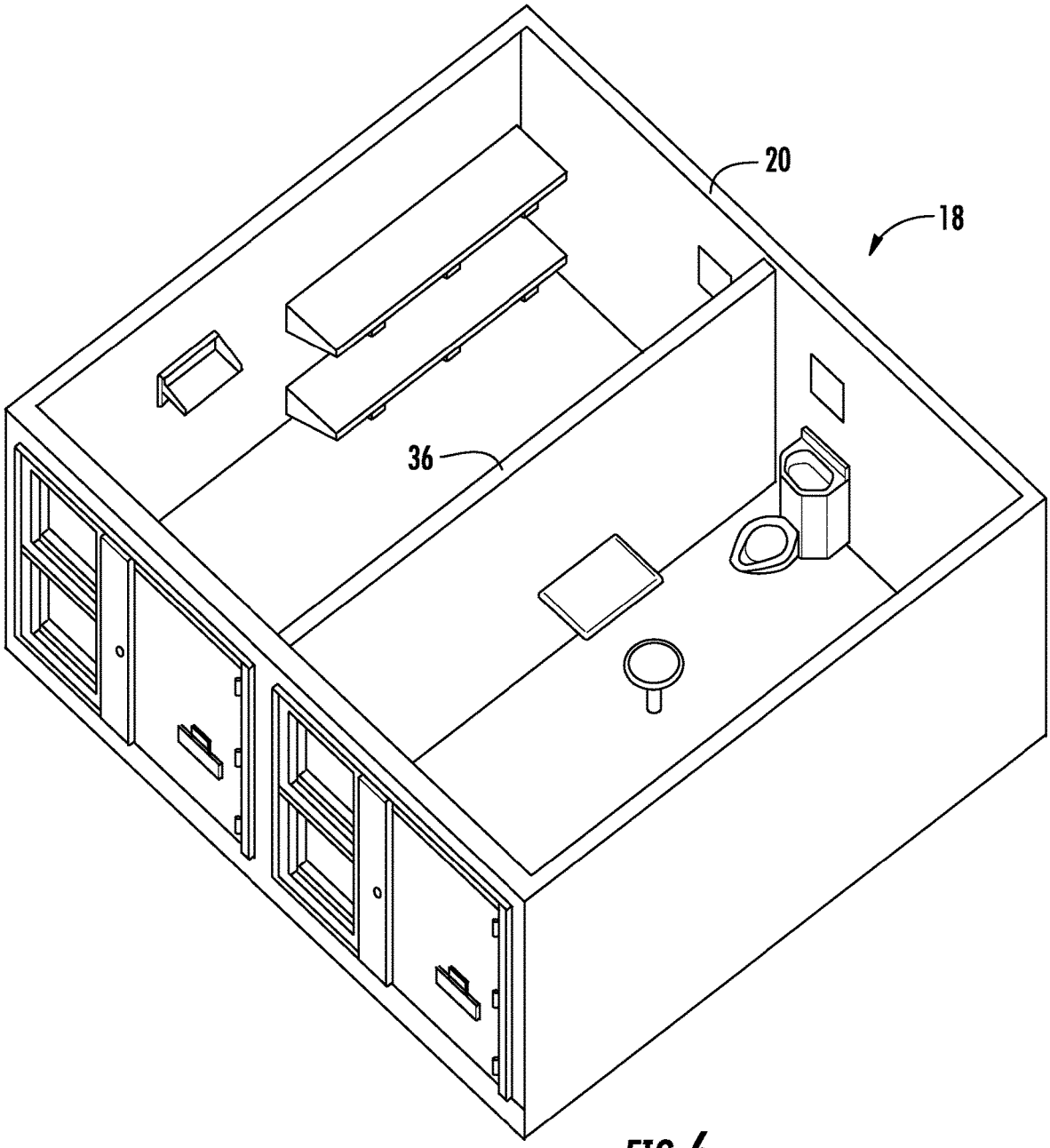
FIG. 6 is a perspective view of an alternative embodiment of the secure enclosure made in accordance with the present disclosure.
Figure 7:
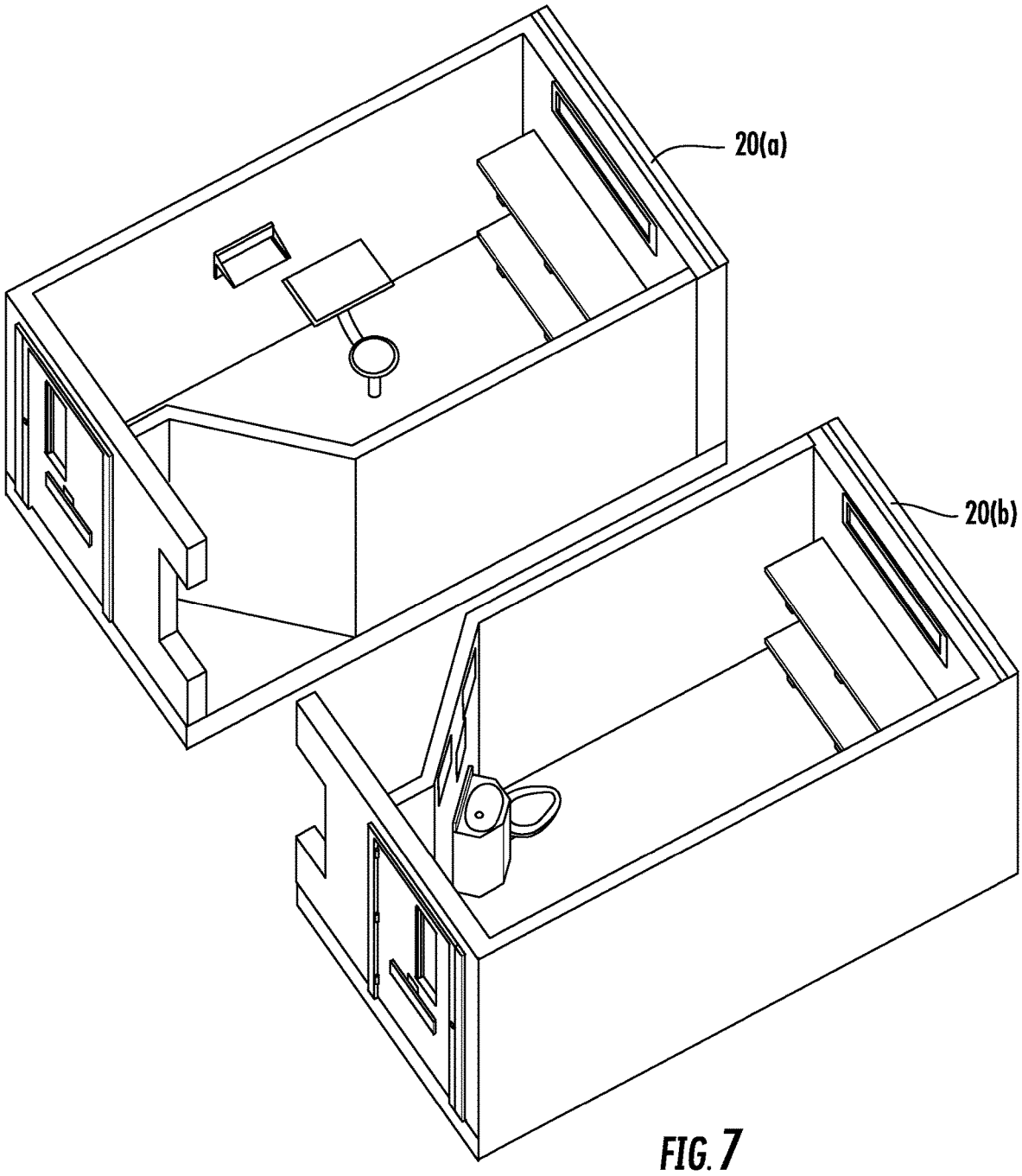
FIG. 7 is a perspective view of an alternative embodiment of the secure enclosure made in accordance with the present disclosure.

FIGS. 6 and 7 illustrate various alternative configurations for the secure enclosure. In FIG. 6, panel 36 takes the form of a flat wall, eliminating the two legs 42 and the associated sub-compartment 48. In FIG. 7, compartment 20 is formed from two physically separate units (20(*a*) and 20(*b*)) that are secured together to form a single unit. Additional panel 36 arrangements can be provided depending upon the size and shape of the room that are desired within the facility. Although the depicted facility is a prison cell, the present disclosure can be used with a variety of other types of facilities; this includes, but is not limited to, telecommunications structures, work camps, storm shelters, and hurricane preparedness housing units.

Although this disclosure has been described in terms of certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure.

What is claimed is:

1. A secure, compartmentalized, and modular facility constructed from pre-fabricated components, the facility comprising:

a rectangular structure including a far wall, a near wall, opposing side walls, a ceiling, and an opened bottom, each of the walls having a height and the ceiling having a length, the walls and ceiling constructed from pre-fabricated monolithically cast and tensioned concrete, a recess extending along the entire height of the far wall, two spaced recesses extending along the entire height of the near wall, a recess extending along the entire length of the ceiling, each of the recesses being approximately ¼ to ½ inch deep;

a metal channel anchored within the recess of the far wall, an L-shaped angle iron anchored within each of the spaced recesses of the near wall, and a U-shaped channel anchored within the recess of the ceiling, the channel, L-shaped angle iron, and U-shaped channel each having lower edges that are secured within the corresponding recesses so that they are inaccessible from within the facility;

a metal panel having a main divider at one end and two legs at an opposite end, the panel further including an upper edge, the panel having a hollow interior, the metal panel being slid upwardly from the opened bottom of the structure with the main divider positioned over the metal channel of the far wall and each leg being positioned over one of the L-shaped angle irons of the near wall, the upper edge of the panel being received within the U-shaped channel of the ceiling.

2. The secure, compartmentalized, and modular facility as described in claim 1 wherein the channel upon the far wall is secured via concrete anchors and bolts.

3. The secure, compartmentalized, and modular facility as described in claim 1 wherein the L-shaped angle irons of the near wall are secured via concrete anchors and bolts.

4. The secure, compartmentalized, and modular facility as described in claim 1 wherein the U-shaped channel of the ceiling is secured via concrete anchors and bolts.

5. The secure, compartmentalized, and modular facility as described in claim 1 wherein the walls and ceiling are formed from pre-tensioned concrete.

6. The secure, compartmentalized, and modular facility as described in claim 1 wherein the walls and ceiling are formed from post-tensioned concrete.

7. The secure, compartmentalized, and modular facility as described in claim 1 wherein fixtures are provided on the walls for affixing a toilet and sink.

8. A facility constructed from pre-fabricated components comprising:

a structure including a far wall, a near wall, opposing side walls, and an opened bottom, each of the walls having a height, the walls being constructed from pre-fabricated concrete, a recess extending along the far wall, two spaced recesses extending along the near wall;

a channel positioned upwardly from the opened bottom of the structure and anchored within the recess of the far wall, and angle irons anchored within each of the spaced recesses of the near wall, the channel and angle irons each having lower edges that are secured within the corresponding recesses;

a metal panel having a main divider at one end and two legs at an opposite end, the panel having a hollow interior, the main divider positioned over the metal channel of the far wall and each leg being positioned over one of the angle irons of the near wall.

9. The facility as described in claim 8 wherein the channel within the far wall is secured via concrete anchors and bolts.

10. The facility as described in claim 8 wherein the angle irons of the near wall are secured via concrete anchors and bolts.

11. The facility as described in claim 8 wherein the two legs of the metal panel define a sub-compartment within the facility.

12. The facility as described in claim 8 wherein fixtures are provided on the walls for affixing a toilet and sink.

* * * * *